US005724084A

United States Patent [19]

Hevenor

[11] Patent Number: 5,724,084

[45] Date of Patent: Mar. 3, 1998

[54] APPARATUS FOR MAKING GRAPHIC PRODUCTS HAVING A CALIBRATED PRINT HEAD, AND METHOD OF CALIBRATING SAME

[75] Inventor: Charles M. Hevenor, Glastonbury, Conn.

[73] Assignee: Gerber Scientific Products, Inc., Manchester, Conn.

[21] Appl. No.: 567,304

[22] Filed: Dec. 5, 1995

[51] Int. Cl.[6] ..... B41J 2/325

[52] U.S. Cl. ..... 347/171

[58] Field of Search ..... 347/171, 172, 347/174, 176; 400/120.01, 120.02, 120.04

[56] References Cited

U.S. PATENT DOCUMENTS

| | | | |
|---|---|---|---|
| 4,562,445 | 12/1985 | Rich | 346/140 |
| 4,680,596 | 7/1987 | Logan | 346/140 |

FOREIGN PATENT DOCUMENTS

| | | |
|---|---|---|
| 60-253566 | 12/1985 | Japan . |
| WO 94/02319 | 2/1994 | WIPO . |
| WO 94/02322 | 2/1994 | WIPO . |

*Primary Examiner*—Huan H. Tran
*Attorney, Agent, or Firm*—McCormick, Paulding & Huber

[57] ABSTRACT

In an apparatus for printing graphic images on sheet material. The thermal print head has a linear array of heating elements extending in the y-coordinate direction, and is movable between a home position and a command position in that direction for printing graphic images wider than the length of the linear array. With the print head in the home position, a first group of heating elements at the upper end of the print head are actuated to print a plurality of first indicia equally spaced relative to each other in the y-coordinate direction. The print head is then moved upwardly in the y-coordinate direction to the command position whereby a second group of heating elements at the lower end of the print head overlap the first indicia. The print head then prints a plurality of second indicia in the spaces defined between adjacent first indicia with the second group of heating elements, and the print head is moved incrementally in the y-coordinate direction between printing sequential second indicia. The second indicia equally spaced between adjacent first indicia is then selected, and the command position of the print head is adjusted based on its total incremental movement corresponding to the selected second indicia to calibrate the movement of the print head in the y-coordinate direction.

22 Claims, 7 Drawing Sheets

FIG. 1
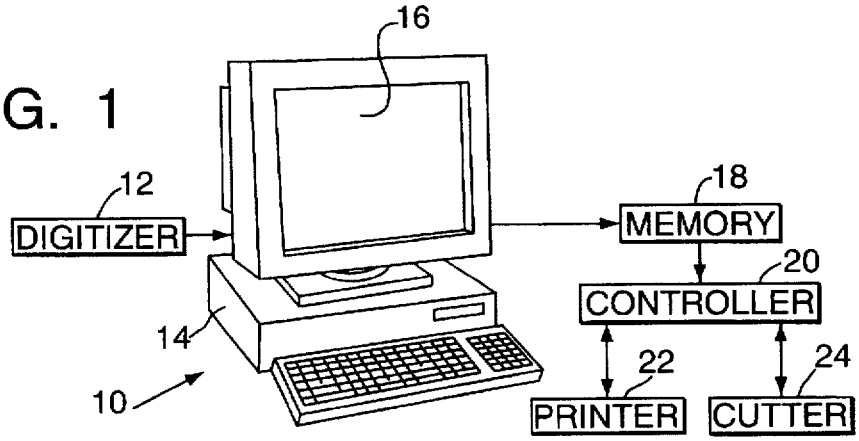
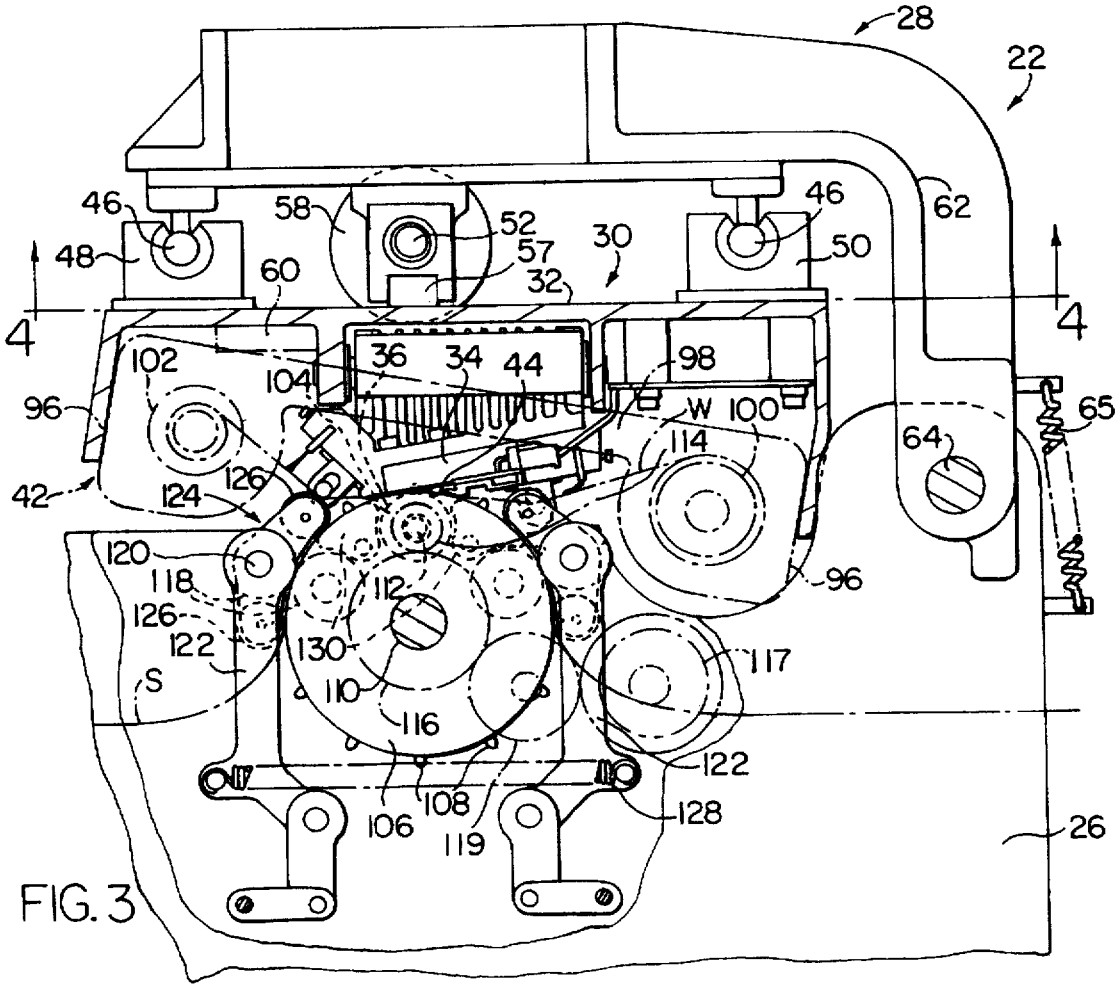
FIG. 3

APPARATUS FOR MAKING GRAPHIC PRODUCTS HAVING A CALIBRATED PRINT HEAD, AND METHOD OF CALIBRATING SAME

FIELD OF THE INVENTION

The present invention relates to apparatus and methods for making graphic products on sheet material, and more particularly, to such apparatus and methods for making graphic products wherein a thermal print head is driven in a lateral direction of the sheets for creating graphic images wider than the length of the print head.

BACKGROUND INFORMATION

One of the most successful systems today for producing sheet material products with multicolored or enhanced graphic images for signs and like displays is the GERBER EDGE™, manufactured by Gerber Scientific Products, Inc. of Windsor Locks, Connecticut. The GERBER EDGE™ is typically used to print graphics for signs or like displays, wherein multicolored or enhanced graphic images are printed on a sheet, and the sheet is cut along the periphery of the graphic images to create a sign or like display. The system uses a thermal print head to print the graphic images on the sheet, and a cutter to cut the sheet along a peripheral edge surrounding the graphic images. The print head and the cutter are controlled by a microprocessor having a common data base so that the printed images and the cut edges correspond positionally in the final graphic product.

A roller platen carrying the sheet material is mounted below the print head, and a removable cassette carrying a donor web bearing transfer ink is mounted adjacent to the print head so that the donor web is interposed between the print head and the sheet. Heating elements of the print head are selectively energized to transfer ink from the donor web to the sheet in accordance with commands from the microprocessor to create graphic images on the sheet. Each cassette carries a donor web bearing a single color of transfer ink, and the cassettes are interchanged to create multicolored images, different shades and/or colors. The roller platen and sheet material are slewed back and forth during printing operations to apply the different color transfer inks.

The GERBER EDGE™ system described above is disclosed in U.S. Pat. No. 5,537,135, dated Jul. 16, 1996, , entitled "Method And Apparatus For Making A Graphic Product", which is assigned to the Assignee of the present invention, and is hereby expressly incorporated by reference as part of the present disclosure.

The sheet material used in the current GERBER EDGE™ is about 15 inches wide and the print head is about 11.8 inches long, thus permitting a maximum width of about 11.8 inches for the graphic images. There is a need, however, for a larger-format system for printing larger-width graphic images on vinyl or like polymeric sheets, such as in the sign-making industry. For example, electric sign shops could use larger-width graphics to create back-lit signs and menu boards more quickly and easily. Such larger-format graphics could also be used to create truck-fleet signs, banners and like large-width displays. Limitations in presently available vinyl-graphics systems require a multiplicity of panels to create such large-width graphic products.

In one larger-format system being developed by the Assignee of the present invention, a thermal print head is driven in a lateral direction of the sheet material to print graphic images wider than the length of the print head. In one mode of operation, the print head is driven in a lateral direction of the sheets (e.g., the y-coordinate or axial direction of the roller platen) and the graphic images are printed in elongated portions or strips, each having a width less than or equal to the length of the print head and extending in the lengthwise direction (or x-coordinate direction) of the sheets. Accordingly, the print head may be moved to a first position in the y-coordinate direction, and the sheet may then be driven relative to the print head in the x-coordinate direction to print a respective strip of graphic images on the sheet. The print head may then be moved to a second position in the y-coordinate direction corresponding to a second graphic strip adjacent to the first strip, and the sheet may then be moved relative to the print head in the x-coordinate direction to print the next strip of graphic images on the sheet. Depending upon the length of the print head and the width of the graphic images to be printed, as many strips as necessary may be printed to cover the full width of the graphic images on the sheet.

One of the difficulties encountered with this type of system is that the first-to-last pixel length of the thermal print heads may vary from one system to the next, or may vary from one print head to the next if the print head in a system is replaced. Accordingly, if all systems are set to drive or offset their print heads the same distance between graphic strips, the variations in the first-to-last pixel length of the print heads, or other dimensional variations in system components can cause a degradation in print quality.

Accordingly, it is an object of the present invention to overcome the drawbacks and disadvantages associated with such dimensional variations in apparatus for making graphic products on sheet material.

SUMMARY OF THE INVENTION

The present invention is directed to an apparatus for printing graphic products on sheet material having a thermal print head which is movable in a lateral direction of the sheet, and a method for calibrating the movement of the print head. The apparatus of the invention comprises a thermal print head including a substantially linear array of heating elements extending in a lateral direction of the sheet material, which is movable between a home position and a command position in the lateral direction of the sheet for printing graphic images on the sheet wider than the length of the linear array. The apparatus further comprises a controller or like means for controlling a first group of heating elements located at approximately one end of the linear array to print a plurality of first indicia spaced relative to each other on the sheet material when the print head is in the home position. The controller or like means then moves the print head from the home position to the command position whereby a second group of heating elements located at approximately the other end of the linear array overlaps the first indicia. The controller then causes the print head to sequentially print a plurality of second indicia in the spaces defined between adjacent first indicia with the second group of heating elements, and incrementally moves the print head in the lateral direction of the sheet between printing sequential second indicia. An operator may then select the second indicia equally spaced between adjacent first indicia, or alternatively, the apparatus may include a sensor or like means for automatically sensing and selecting the second indicia equally spaced between adjacent first indicia. The control unit then adjusts the command position of the print head based on its total incremental movement corresponding to the selected second indicia.

In one embodiment of the present invention, a step motor is coupled to the print head to drive the print head in the lateral direction of the sheet, and the incremental movement between sequential second indicia corresponds to a predetermined number of steps of the motor. In this embodiment, the command position of the print head is adjusted by adding to the original command position the total number of incremental steps of the motor corresponding to the selected second indicia.

Accordingly, the apparatus and method of the present invention compensate for variations in the first-to-last pixel length from one print head to the next, or other dimensional variations that might affect print quality as a result of lateral movement of the print head. Precise registration between the print head and the sheet material is therefore maintained, and a degradation in print quality that might otherwise result from such dimensional variations is avoided.

Other objects and advantages of the apparatus and method of the present invention will become apparent in view of the following detailed description and accompanying drawings.

BRIEF DESCRIPTION OF THE DRAWINGS

FIG. 1 is a schematic diagram illustrating a system embodying the present invention for thermal printing and cutting signs and other graphic products.

FIG. 3 is a partial, side elevational view of the thermal printing apparatus of FIG. 2 with portions broken away to show internal structure.

DETAILED DESCRIPTION

Figure 2:
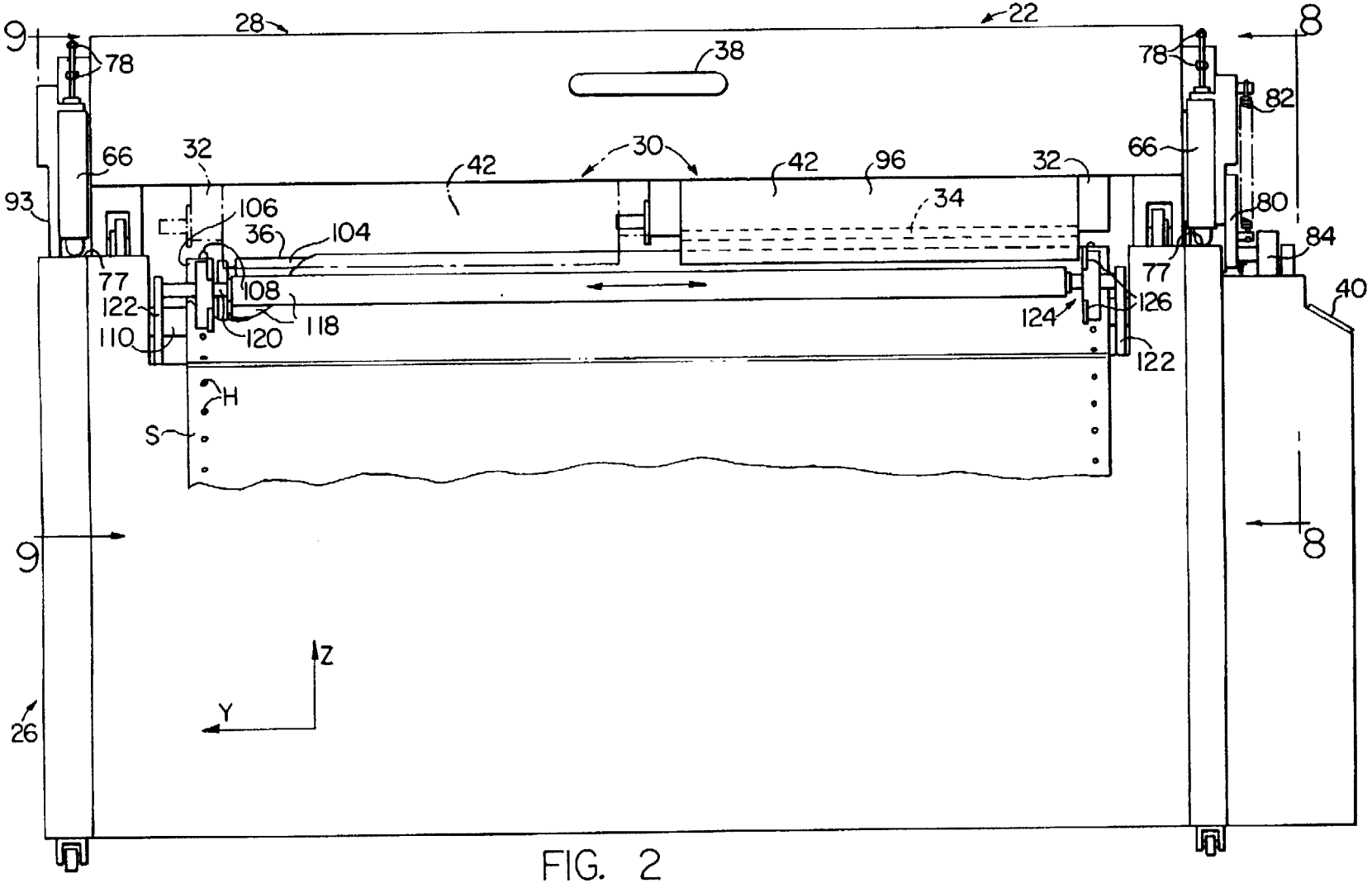
FIG. 2 is a front elevational view of a thermal printing apparatus employed in the system of FIG. 1 and embodying the present invention.

In FIG. 1, an apparatus embodying the present invention for making graphic products with multicolored and/or enhanced graphic images is indicated generally by the reference numeral 10. The apparatus of FIG. 1 enables a graphic product to be created and produced with enhancements from a data base within which the printed and cut features of the product are commonly based. The apparatus 10 includes a digitizer 12 or other data input device which transmits data to a computer 14 defining at least the peripheral edges of the graphic product and possibly internal edges as well. The computer 14 displays the data defining the edges as an image on a monitor 16. Then, printing enhancements from a special enhancement program within the computer's memory 18 for creating and printing graphic images are added within the edges of the displayed image as the operator or composer desires by employing a keyboard, mouse and/or like input device.

From the data defining an enhanced graphic product, the computer 14 generates at least one printing program for operating a controller 20 to control a printing apparatus 22 to print the prepared graphic images on a sheet material. If desired, the computer may also generate a cutting program for operating the controller 20 to control a cutting apparatus 24 to cut the sheet material around the graphic images and create the final graphic product.

In a preferred embodiment of the present invention, the sheet material is typically a vinyl secured by a pressure-sensitive adhesive on a releasable backing. One such vinyl is sold by the Assignee of this invention under the trademark SCOTCHCAL™ of the 3M Company. As will be recognized by those skilled in the pertinent art, however, numerous other types of sheet material may equally be employed, such as paper and other types of polymeric sheets, including polyvinyl chloride (PVC) and polycarbonate sheets. Similarly, the sheet material may be supplied in any length on rolls, in flat sheets, or as otherwise desired.

The printing apparatus 22 prints the graphic images on the sheet material, and the printed sheet may be transferred to the cutting apparatus 24 which is operated by the controller 20 to cut the sheet along the peripheral edges of the graphic images and any internal edges, if necessary, in accordance with the cutting program. With vinyl sheets as described above, after weeding to remove unwanted vinyl material within or around the printed images, the vinyl forming the enhanced image is lifted from the underlying backing and may be attached to a sign board, window or other object for display.

A suitable cutting apparatus 24 for carrying out the cutting operation on sheets of vinyl or other material is disclosed in U.S. Pat. Nos. 4,467,525, 4,799,172 and 4,834,276, all owned by the Assignee of the present invention.

Turning to FIG. 2, a unique printing apparatus 22 embodying the present invention for carrying out the printing operation comprises a base assembly 26 and a cover assembly 28 pivotally mounted to the base. The cover assembly 28 supports a print head assembly 30 comprising a print-head carriage 32 carrying a thermal print head 34 for moving and positioning the print head in the illustrated y-coordinate direction. A roller platen 36 is rotatably mounted on the base assembly 26 for supporting a strip of sheet material S driven between the roller platen and the print head for printing graphic images on the top surface of the sheet S. The cover assembly 28 includes a handle 38 for opening and closing the cover to expose the internal structure of the apparatus.

The printing apparatus 22 may utilize sprockets or other suitable registration means to engage corresponding feed holes H in the sheet material S. The feed holes H may extend along each longitudinal edge of a strip S of sheet material in order to register and steer the sheet material driven between the roller platen and print head. Correspondingly, the cutting apparatus 24 (FIG. 1) may also include a set of sprockets to engage the same series of feed holes H during the cutting operation to likewise register the sheet material with a cutting blade. Accordingly, the registration of the cut edges of the graphic product with the printed image is insured in the longitudinal direction. Since the graphic image is absolutely fixed both transversely and longitudinally on the strip S relative to the feed holes H, the feed holes are a proper reference for the image in both the printing and cutting operations.

The sheet material S may be supplied on a roll (not shown) supported on the back side of the base assembly 26, and after the sheet passes through the printing apparatus 22 where the printing operation takes place, it is discharged freely at the front side of the apparatus as shown, or may be retrieved on a take-up reel if desired.

Although the printing apparatus 22 is connected to the controller 20 in FIG. 1 for controlling the printing operation, the printer includes a control panel 40 on the base assembly 26 to, for example, stop and start printing operations. The control panel 40 also includes controls for driving the sheet S independently of the printing operation and other controls for operating the printer. As will be recognized by those skilled in the pertinent art, the controller 20 may partially reside in both the printer 22 and computer 14, or may entirely reside in either the printer or computer.

With reference to FIG. 3, a replaceable cassette 42 (shown in phantom) is installed on the print-head carriage 32 mounted beneath the cover 28, and carries a web W bearing the printing ink, which is interposed between the print head 34 and sheet material S on the roller platen 36. The thermal print head 34 extends longitudinally in the axial direction of the roller platen, and is pressed downwardly onto the ink web W and sheet material S to generally establish a linear zone of contact between the ink web, sheet, and roller platen. The print head 34 includes a plurality of heating elements 44 distributed evenly along the head from one end to the other, and the heating elements are densely packed along the line of contact.

As is described further below, during a printing operation, the ink web W and sheet material S are simultaneously driven between the print head 34 and roller platen 36, and the heating elements 44 of the print head are selectively energized so that the portion of the ink immediately beneath each energized heating element is released from the ink web and transferred to the sheet material. With high density heating elements, graphic images of high resolution are thus created on the strip S of sheet material. The excitation of the heating elements is controlled in accordance with the program of printed material that is read by the controller 20 from the memory 18 in FIG. 1.

Figure 4:
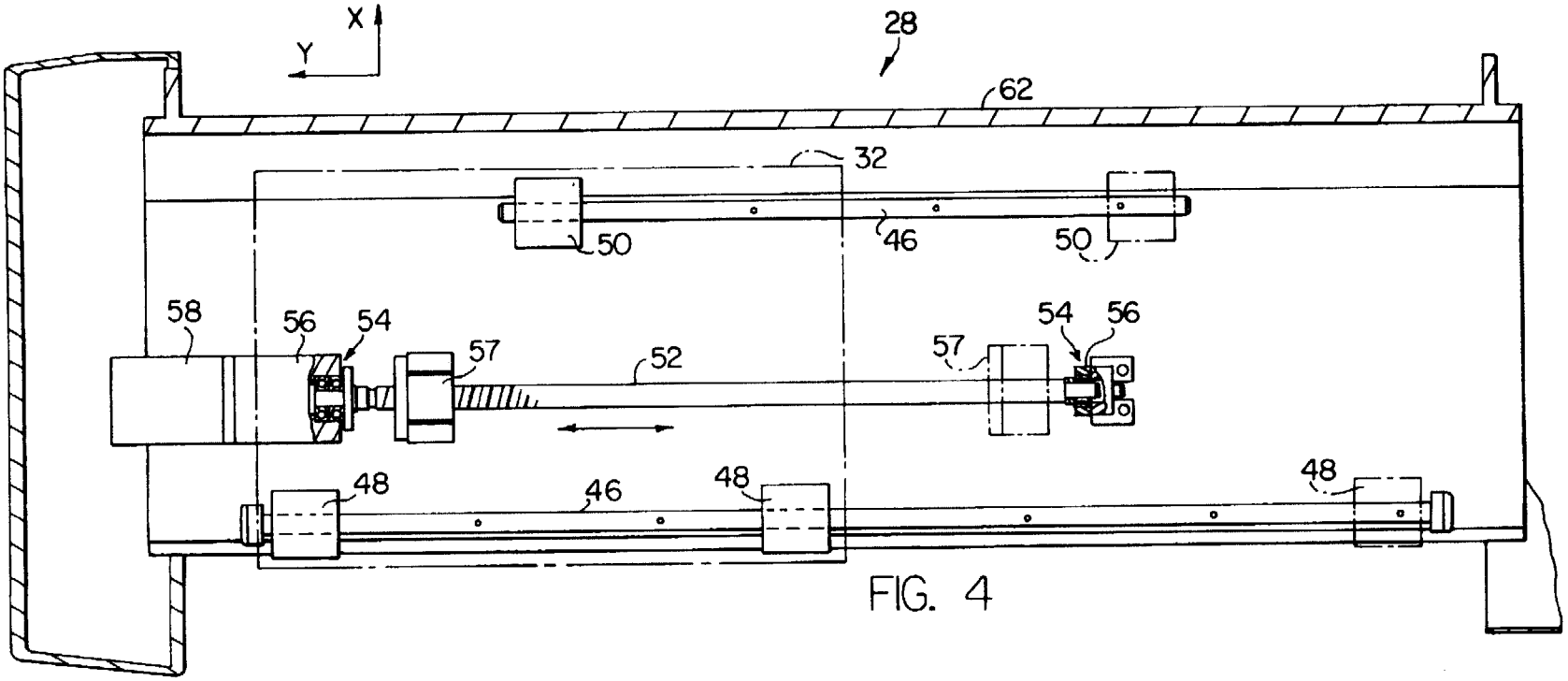
FIG. 4 is a cross-sectional view taken along line 4—4 of FIG. 3 illustrating the drive system for moving the print head in the y-coordinate direction.

As shown in FIGS. 3 and 4, a pair of parallel guide bars or ways 46 are fixedly mounted to the underside of the cover 28, and are each oriented parallel to the axis of the roller platen 36 and extend through a substantial portion of the roller platen's length. The print-head carriage 32 is mounted to the front way 46 by a pair of bearing blocks 48 fixedly mounted on opposite sides of the carriage relative to each other, and is mounted to the rear way 46 by a single bearing block 50 spaced approximately midway between the two front bearing blocks 48 in the axial direction of the ways.

As shown best in FIG. 4, a lead screw 52 is rotatably mounted on each end by bearing assemblies 54, which are each in turn mounted within a respective support block 56 fixedly mounted to the underside of the cover 28. As shown in FIG. 4, the lead screw 52 is spaced between, and oriented parallel to the two ways 46; and is threadedly received through a drive block 57, which is in turn fixedly attached to the print-head carriage 32. A y-drive motor 58 is coupled to one end of the lead screw 52 to rotatably drive the lead screw, and is in turn electrically connected to the controller 20 in order to drive and position the print-head carriage 32 and print head in the y-coordinate direction, as indicated by the arrows in FIGS. 2 and 4. In the preferred embodiment illustrated, the y-drive motor is a step motor; however, as will be recognized by those skilled in the pertinent art, numerous other drive systems may be employed to accurately drive and position the print head assembly in the y-coordinate direction.

The printing apparatus 22 controls the print head assembly 30 to print graphic images on the sheet material S wider than the length of the print head 34 by rotatably driving the step motor 58 and lead screw 52 to move the print head between first and second positions in the y-coordinate or lateral direction of the sheet S. In one mode of operation, the print head 34 is driven in the lateral direction of the sheet, which in the embodiment of the present invention illustrated is the y-coordinate or axial direction of the roller platen 36, and the graphic images are printed in elongated portions or strips, each having a width less than or equal to the length of the print head and extending in the lengthwise direction (or x-coordinate direction) of the sheet.

Accordingly, with the print head assembly 30 raised in the z-coordinate direction so that the print head is spaced above the sheet material S and roller platen, as is described further below, the print head assembly is initially moved to a first or home position in the y-coordinate direction, as shown in solid lines in FIG. 2. The print head 34 is then lowered in the z-coordinate direction so as to press the ink web W into engagement with the sheet S against the roller platen, and the sheet is then driven relative to the print head in the x-coordinate direction to print a respective strip of graphic images on the sheet. The print head assembly 30 is then raised and in turn moved to a command or second position in the y-coordinate direction corresponding to a second graphic strip adjacent to the first strip, as shown in broken lines in FIG. 2. Then, in the command position, the print head is lowered against the sheet S, and the sheet is driven relative to the print head in the x-coordinate direction to print the next strip of graphic images on the sheet. In the embodiment of the present invention illustrated, the print head 34 is approximately 11.8 inches long, and the length of the roller platen 36 is selected to accommodate sheet material S of sufficient width to receive graphic images at least twice as wide as the length of the print head. As will be recognized by those skilled in the pertinent art, however, depending upon the length of a particular print head, the width of the sheet material, and the width of the graphic images to be printed, the printing apparatus 22 may be configured to print as many strips as necessary in order to cover the full width of a desired sheet.

Figure 5:
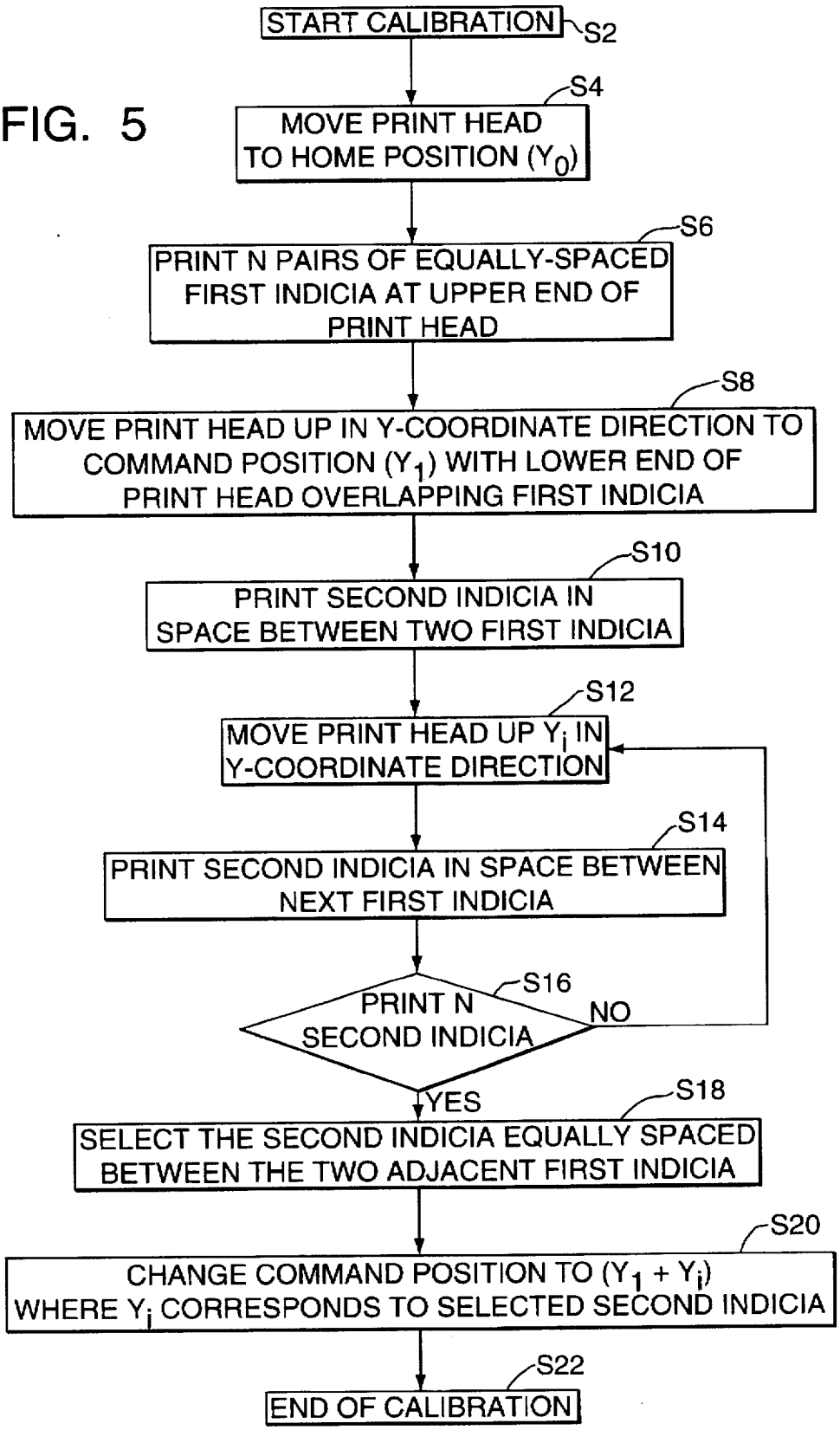
FIG. 5 illustrates the subprograms of the system controller code, and their order of execution, for performing the various functions necessary to calibrate the movement of the print head in accordance with the present invention.

FIG. 5 illustrates the subprograms or software modules, and their order of execution, resident in the firmware of the controller 20 for performing the various functions and procedures of the present invention necessary to calibrate the movement of the print head in the y-coordinate direction to thereby compensate for dimensional variations in system components, such as variations in the first-to-last pixel length of the print heads. As will be recognized by those skilled in the pertinent art, although the subprograms of this exemplary embodiment are resident in the firmware of the controller 20, they may alternatively be embodied as executable software resident in storage media, such as floppy disks or CD-Roms, for processing and execution upon a microprocessor, and/or embodied in programmable integrated-circuit devices, such as PLAs, Proms, and E-Proms.

Figure 6:
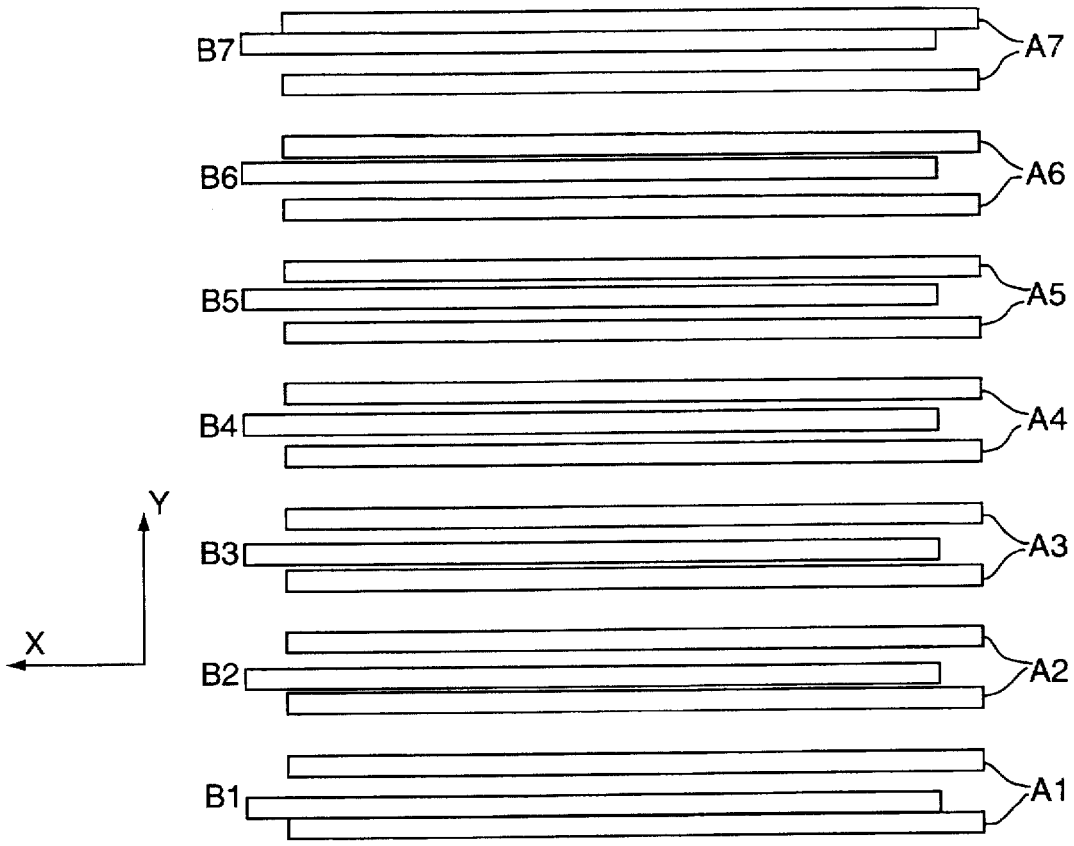
FIG. 6 is an exemplary representation of a plurality of pairs of first indicia (A1–A7) and corresponding second indicia (B1–B7) printed on a strip of sheet material by the printing apparatus of FIG. 2 for calibrating the movement of the print head in the y-coordinate direction in accordance with the present invention.

As indicated by reference S2 in FIG. 5, an operator may initiate the calibration procedure by inputting a start calibration command to the controller 20 either on the computer 14 or the control panel 40 of the printer. Alternatively, the firmware in the controller may be configured to automatically initiate the start calibration command (S2) when the apparatus is first installed. The controller 20 then controls the y-drive motor 58 to rotatably drive the lead screw 52 and in turn position the print head assembly 30 and print head 34 in a home position ($y_0$) in the y-coordinate direction, as indicated by S4. The controller 20 then actuates the print head 34 to print N pairs of equally-spaced first indicia on the sheet material S at the upper end of the print head, as indicated by S6. As shown in the example of FIG. 6, the print head 34 may print seven (7) pairs of rectangular-shaped bars A1–A7, which are equally spaced relative to each other in the y-coordinate direction and longitudinally extend in the x-coordinate direction. The controller 20 then drives the print head assembly 30 upwardly in the y-coordinate direction to a command position ($y_1$) so that a plurality of heating elements 44 at the lower end of the print head overlap the first indicia A1–A7, as indicated by S8 in FIG. 5.

As shown in the example of FIG. 6 and indicated by S10 in FIG. 5, the print head 34 is then actuated to print a second indicia B1 in the space defined between the first pair of indicia A1. In the example of FIG. 6, like the bars forming the first indicia A1–A7, each second indicia B is also a rectangular-shaped bar extending longitudinally in the x-coordinate direction. The print head assembly 30 is then moved upwardly an incremental distance in the y-coordinate direction ($y_i$), and the print head 34 is actuated to print the next second indicia (B2) in the space between the next pair of first indicia (A2), as indicated by S12 and S14 and shown in FIG. 6. In the embodiment of the present invention illustrated, the incremental distance $y_i$ corresponds to a single step of the y-drive motor 58 of FIG. 4. The step size of the y-drive motor is preferably chosen to be considerably smaller than the pitch of the heating elements 44 of the print head. In this exemplary embodiment of the invention, the step size was selected to be ⅛ of the nominal pitch of the heating elements.

The procedure of sequentially printing the second indicia B in the spaces defined between the pairs of first indicia A, and incrementally moving the print head assembly a predetermined distance $y_i$ between printing sequential second indicia is continued until all second indicia B1–B7 are printed in the spaces between the corresponding pairs of first indicia A1–A7, as indicated by S12–S16 of FIG. 5 and shown in FIG. 6. The operator then selects the second indicia B that is evenly spaced between the adjacent pair of first indicia A (S18 in FIG. 5), in order to calibrate the movement of the print head in the y-coordinate direction. In the example of FIG. 6, the second indicia B4 is evenly spaced between the pair of first indicia A4, and therefore the operator would select indicia B4 and input this selection through the computer 14 or control panel 40 to the controller 20. Preferably, the firmware in the controller 20 is also configured to control the print head to print the corresponding alphanumeric characters adjacent to the second indicia, such as the characters B1–B7 shown in FIG. 6, to facilitate selection of the second indicia. In this case, for example, the operator may input into the computer 14 a "4" or "B4" to select this second indicia for calibration.

The firmware of the controller 20 is configured to in turn adjust the command position $y_1$ to correspond to the position of the selected second indicia (S20 in FIG. 5) as follows:

$$y_1(\text{new})=y_1(\text{old})+y_i(\text{sum}),$$

wherein $y_1$(new) is the calibrated command position, $y_1$(old) is the original command position, and $y_i$(sum) is the total incremental movement of the print head from the original command position ($y_1$(old)) in the y-coordinate direction corresponding to the selected second indicia (B4 in FIG. 6). In the example of FIG. 6, because the selected second indicia is B4, $y_i$(sum) corresponds to four steps of the y-drive motor 58. In the exemplary embodiment of the invention, the head positioning commands to the printer address the command position by heating elements (or pixels). The firmware is configured to in turn determine the number of motor steps required to move the print head to the command position. Accordingly, the effect of the calibration procedure described herein is to adjust the motor steps to heating element ratio.

Figure 7:
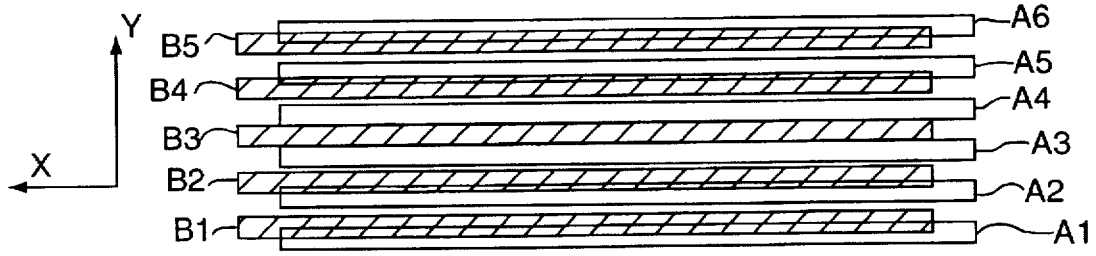
FIG. 7 is another exemplary representation of a plurality of first indicia (A1–A6) and corresponding second indicia (B1–B5) printed on a strip of sheet material for calibrating the movement of the print head in accordance with the present invention.

As will be recognized by those skilled in the pertinent art, the first and second indicia may take numerous different shapes and configurations in accordance with the calibration system and procedure of the present invention. Similarly, the number and relative spacing of the first and second indicia will be selected depending upon the specific requirements of a particular system. For example, as shown in FIG. 7, the controller code may be configured to control the print head to print a plurality of first indicia $A_1$–$A_n$ equally spaced relative to each other in the y-coordinate direction (or lateral direction of the sheet material S), and to sequentially print a plurality of second indicia $B_1$–$B_{n-1}$ in the spaces defined between adjacent first indicia. As in the example of FIG. 6, the print head is moved upwardly in the y-coordinate direction an incremental distance ($y_i$) between printing each sequential second indicia B. As shown in FIG. 7, the width of each space between adjacent first indicia ($A_1$–$A_n$) may be equal to the width of each second indicia ($B_1$–$B_{n-1}$) so that the selected second indicia B completely fills the gap between adjacent first indicia. In the example of FIG. 7, the second indicia B3 fills the space between the adjacent first indicia A3 and A4, and would therefore be selected to calibrate the print head.

As will also be recognized by those skilled in the pertinent art, it may be desirable to set the original command position of the print head ($y_1$(old)) at an approximate mid-point or other location amongst the first indicia A, and to incrementally move the print head from the original command position up and/or down in the y-coordinate direction between printing sequential second indicia. Similarly, if there are several command positions of the print head, wherein each command position corresponds to a respective strip of graphic images to be printed on the sheet material, each command position may be individually calibrated as described herein. Alternatively, the controller code may be configured to repeat the calibrated distance between the home position and the first command position for each successive command position.

The printing apparatus 22 may further include an optical sensor 60 mounted, for example, on the print head assembly 30 adjacent to the lower end of the print head, as shown in broken lines in FIG. 3, to scan the first and second indicia, and transmit signals to the controller 20 indicative of the selected second indicia for automatically calibrating the print head, as described above. For example, in the embodiment of FIG. 6, the optical sensor 60 detects the second indicia equally spaced between the corresponding pair of first indicia. Preferably, the sheet material S defines an optically-reflective surface, such as that formed by a white sheet, in order to permit the sensor to accurately scan and detect the evenly-spaced second indicia. Similarly, in the example of FIG. 7, the optical sensor 60 detects the location where there is no reflective gap between adjacent first indicia, thus indicating the position of the selected second indicia B3.

Figure 8:
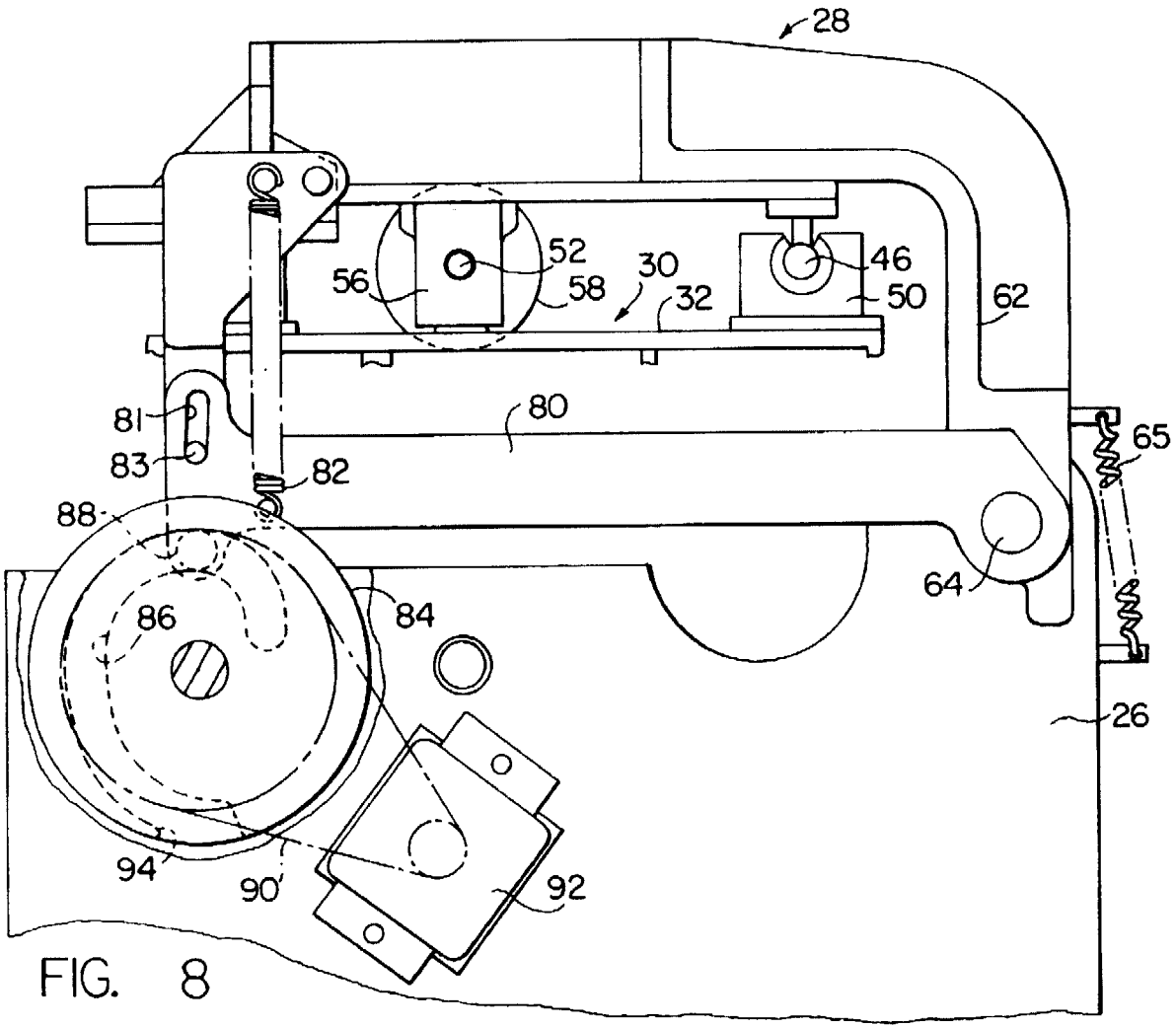
FIG. 8 is a partial cross-sectional view of the thermal printing apparatus taken along line 8—8 of FIG. 2 with the print head and other parts removed for clarity.

As described above, the print head 34 is positioned in the y-coordinate direction by raising the print head assembly 30 in the z-axis, driving the print head assembly to the desired position in the y-coordinate direction, and then lowering the print head and ink web W into engagement with the sheet material S to print the graphic images on the sheet. Accordingly, the printing apparatus 22 further comprises means for moving the print head 34 into and out of engagement with the ink web W and sheet material S supported on the roller platen 36, and for regulating the amount of pressure applied to the ink web and sheet by the print head. With reference to FIGS. 3 and 8, the cover assembly 28 comprises a support frame 62 supporting the ways 46 and print head assembly 30, and which is pivotally mounted on the backside of the base assembly 26 by an axle 64. Accordingly, the support frame 62 and print head 34 are pivoted toward and away from the roller platen 36 upon closing and opening the cover assembly 28, respectively. As shown in FIG. 8, a coil spring 65 is coupled between the back side of the cover 28 and the base 26 to assist in opening the cover and to prevent the cover from closing under its own weight.

As shown in FIG. 2, the cover assembly 28 further comprises a pair of spring-loaded supports 66 mounted on its front corners for resiliently supporting the cover, and thus the print head on the base assembly 26. As shown typically in FIG. 9, each spring-loaded support 66 comprises a plunger 68 received within the cylindrical bore 70 of a support sleeve 72 mounted on the respective front corner of the cover. A coil spring 74 is seated between the shaft of each plunger 68 and the respective sleeve, and is retained within the sleeve by a retaining ring 76 fixedly attached to the top end of the sleeve. Accordingly, as the cover assembly is pivoted downwardly toward the base assembly, the bottom end of each plunger 68 engages a corresponding support surface 77 of the base, and is in turn pushed upwardly by the weight of the cover against the respective coil spring 74. The spring-loaded supports 66 thus provide a means for resiliently mounting the cover assembly against the base and in turn resiliently supporting the print head 34 in engagement with the roller platen 36, as is described further below. As also shown typically in FIG. 9, a pair of adjustment nuts 78 are threadedly attached to the upper end of each plunger 68 to set the compression on the spring 74 and the positions of the plungers.

The projecting or cantilevered end of the cover assembly 28 is coupled to a pressure-regulating mechanism adjustable by the controller 20 to move the print head 34 into and out of engagement with the sheet material and ink web on the roller platen and to control the pressure applied by the print head to the ink web and sheet. As shown in FIG. 8, a pressure arm 80 is mounted on one end to the axle 64 and projects outwardly toward the front end of the cover assembly for pivotal movement with the cover. The projecting end of the pressure arm 80 defines a first cam slot 81 which slidably receives a pin 83 fixedly mounted to the cover; and a coil tension spring 82 is connected between the same end of the pressure arm and the cover to bias the pressure arm upwardly toward the cover and in turn bias the print head downwardly toward the roller platen, as is described further below. A cam 84 is rotatably mounted on the base assembly 26 and defines a second or spiral cam slot 86 (shown in phantom) which receives and engages a cam follower 88 (also shown in phantom) connected to the projecting end of the pressure arm 80. As shown in FIG. 3, the cam 84 is coupled by a toothed drive belt 90 to a pressure-regulating step motor 92.

Accordingly, as the cam 84 is rotated by the pressure-regulating step motor 92, the relative movement of the cam follower 88 within the spiral cam slot 86 causes the pressure arm 80 and in turn the cover assembly and print head 34 to move up or down, depending upon the direction of rotation of the cam, to thereby move the print head into and out of engagement with the sheet material and to adjust the pressure applied to the ink web W and sheet material S between the print head and roller platen. When the print head and ink web are spaced above the sheet material and roller platen, the pin 83 rests on the "floor" of the first cam slot 81 as shown in FIG. 8. Then, as the cam 84 is rotated in the counterclockwise direction in FIG. 8, the print head 34 and ink web W are lowered into engagement with the sheet material S and roller platen 36 (FIG. 3). Upon engaging the sheet material, the print head rests against the roller platen, and the pin 83 is moved upwardly through the first cam slot 81 into engagement with the "roof" or upper end of the first cam slot. This in turn pulls the tension spring 82 downwardly in FIG. 8 so that the tension spring and the spring-loaded supports 66 resiliently support the print head against the sheet material and roller platen.

The pressure-regulating motor 92 is coupled to the controller 20, and the controller code is configured to in turn control rotation of the cam 84 to precisely move the print head into and out of engagement with the sheet material and to set the pressure applied to the ink web and sheet. As also shown in phantom in FIG. 8, the cam slot 86 defines an exit point 94 at the periphery of the cam 84, so that the cam follower and correspondingly the cover assembly 28 can be lifted completely free of the cam when the controller 20 controls rotation of the cam to its upright position.

Figure 9:
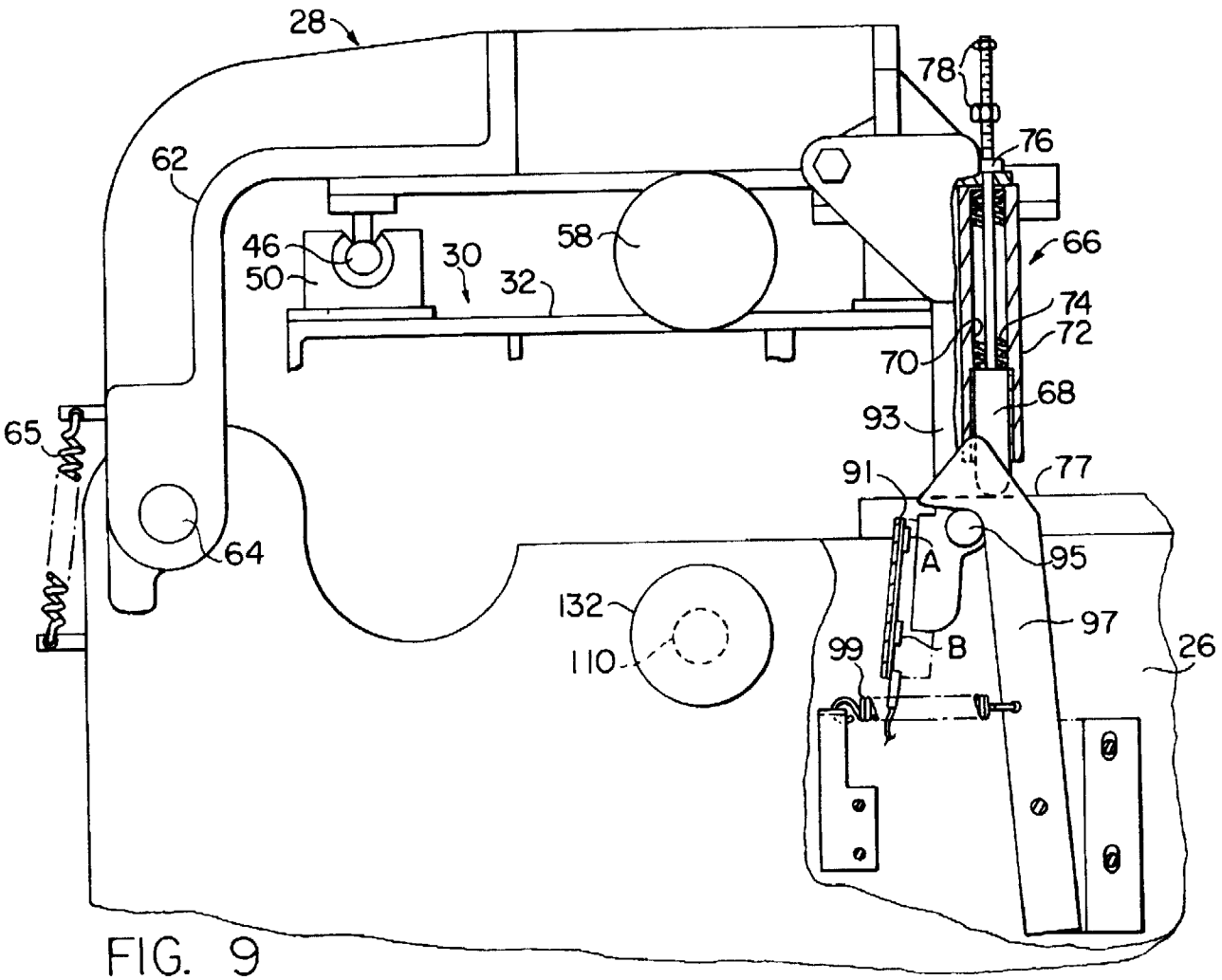
FIG. 9 is a partial cross-sectional view of the thermal printing apparatus taken along line 9—9 of FIG. 2 with the print head and other parts removed for clarity.

The printing apparatus 22 also includes means for automatically sensing when the cover assembly 28 is fully closed and the print head 34 is lowered into a printing position. With reference to FIG. 9, a position sensor 91 is mounted to the base assembly 26 in order to detect the presence of a depending arm 93 of the cover assembly. An engagement pin 95 is fixedly mounted to the free end of the arm 93, and engages a hooked arm 97 pivotally mounted to the base assembly and biased inwardly toward the pin by a coil spring 99. Accordingly, upon closure of the cover assembly 28, the pin 95 initially engages the top surface of the hooked arm 97 and pushes the arm outwardly. Then, as the pin 95 passes below the hooked end of the arm 97, the arm is biased inwardly by the spring 99 to catch the pin within the hook of the arm and thereby prevent accidental opening of the cover. When the print head 34 is later lowered into a printing position by the cam 84, the sensor 91 transmits a signal to the controller 20 indicating that the print head is properly positioned and thereby enabling a printing operation.

Although the sensor 91 may be any of numerous known types of sensors, in the embodiment of the invention illustrated the sensor 91 is a hall-effect sensor. As shown in FIG. 9, the hall-effect sensor 91 includes a first sensor A and a second sensor B spaced below A. Accordingly, when the first sensor A senses the presence of the arm 93 it transmits a signal to the controller 20 indicating that the cover 28 is closed and that the arm 97 is in the locked position to prevent accidental opening of the cover. Then, when the second sensor B senses the presence of the arm 93 it transmits a signal to the controller 20 indicating that the print head has been sufficiently lowered into engagement with the roller platen to print on the sheet material.

As mentioned above, the cassette 42 carrying the ink web W is replaceable, and is shown in the installed position in FIG. 3. A preferred construction of the cassette and the mechanism for mounting the cassette are illustrated and described in detail in the above-mentioned co-pending patent application. Briefly, however, each cassette 42 is easily installed and removed from the print-head carriage 32 when the cover assembly is lifted to a fully-open position to, for example, replace a depleted cassette or select a different ink for printing.

As shown in FIG. 3, each cassette 42 comprises two end shells 96 and two molded side rails 98 (one shown) extending between the end shells and defining a generally rectangular configuration with an opening in the center. The ink web W is attached on each end to spools (not shown) rotatably mounted and enclosed within each end shell 96, and the ink web is passed from one spool to the other through the central opening in the cassette. As shown in FIG. 3, the print head 34 passes downwardly into the central opening of the cassette 42 and presses the ink web W onto the sheet material S along the linear zone of contact. A slip clutch or drag brake 100 is coupled to the supply spool of the cassette 42 to impose a frictional restraint on the spool as the ink web W is pulled off the spool.

As also shown in FIG. 3, a web drive motor 102 is coupled through a slip clutch (not shown) to the opposite or take-up spool of the cassette 42. The drive motor 102 is coupled to the controller 20, and when engaged it applies a torque to the take-up spool, and thus produces a uniform tension force on the ink web W. The web drive motor 102 is engaged only during printing operations, and the force applied to the ink web is limited by the slip clutch (not shown) so that the actual movement of the web is controlled by movement of the roller platen 36. Accordingly, the web W and sheet material S are pressed between the print head 34 and roller platen 36 and move synchronously relative to the print head during printing operations. During non-printing operations, on the other hand, the controller 20 relieves the pressure applied by the print head and de-energizes the web drive motor 102 so that when the sheet material S is slewed, the ink web neither moves, nor is it consumed.

The apparatus 10 preferably employs a platen drive to move the sheet material S relative to the print head 34 with encoded sprockets and/or an encoded sprocket shaft to maintain precise registration of the sheet material with the print head, as described, for example, in co-pending U.S. patent application Ser. No. 08/440,083, filed May 12, 1995, entitled "Apparatus For Making Graphic Products Having A Platen Drive With Encoded Sprockets", which is assigned to the Assignee of the present invention, and is hereby expressly incorporated by reference as part of the present disclosure.

As shown partially in FIG. 2, the roller platen 36 includes a hard rubber sleeve 104 for engaging and driving the sheet material S. The polymeric material of the sleeve 104 is selected to provide a firm surface to support the sheet material S beneath the print head, and to enhance the frictional engagement of the platen with the backing of the strip to effectively drive the strip. A marginal edge portion of the sheet material S overlaps the rubber sleeve 104 of the roller platen at each end and is engaged by a respective registration sprocket 106. As shown typically in FIG. 3, each registration sprocket 106 includes a plurality of sprocket pins 108, which are received within the feed holes H of the sheet material to guide and steer the sheet, and precisely maintain registration of the sheet as it is driven by the roller platen beneath the print head.

As also shown typically in FIG. 3, the registration sprockets 106 are each mounted to a common sprocket shaft 110, which is in turn rotatably mounted on each end to the base assembly 26. Each registration sprocket 106 is fixed to the shaft 110 in its rotational direction so that the sprockets rotate in sync with each other and the shaft, but may be slidably mounted in the axial direction of the shaft to permit lateral adjustment of the sprockets to accommodate sheet materials of different width.

The roller platen 36 is spaced adjacent and oriented parallel to the sprocket shaft 110, and is mounted on a drive shaft 112, which is in turn rotatably mounted to the base assembly 26. As shown in broken lines in FIG. 3, a platen drive gear 114 is fixedly mounted to the platen drive shaft 112, and is meshed with an idler gear 116 rotatably mounted to the sprocket shaft 110. As also shown in broken lines in FIG. 3, a platen drive motor 117, which may be, for example, a step motor, is mounted to the base assembly 26, and is coupled through a suitable gear train 119 to the idler gear 116. Actuation of the platen drive motor rotatably drives the idler gear 116, and in turn directly drives the platen drive gear 114 and roller platen 36. As will be recognized by those skilled in the pertinent art, other suitable means may be employed to drivingly connect the platen drive motor to the roller platen, such as a drive belt.

As also shown in FIG. 3, two pairs of nip rolls 118 are rotatably mounted on opposite sides of the roller platen 36 relative to each other to pinch the sheet material S as it is driven between each pair of rolls and maintain the sheet in a smooth and uniform condition as it is driven by the roller platen beneath the print head. Each outer nip roll 118 is rotatably mounted on each end by a shaft 120 to a respective swing arm 122, shown typically in FIG. 3, which is in turn pivotally mounted to the base assembly 26. As also shown typically in FIG. 3, each swing arm 122 comprises a bail assembly 124 mounted on the shaft 120 of the respective nip roll and including a pair of rotatably-mounted wheels 126 which straddle the pins 108 of each registration sprocket 106 and keep the sheet material fully engaged with approximately 180° of the registration sprockets. As also shown typically in FIG. 3, the opposing swing arms 122 are each coupled together by a respective spring 128 to bias the swing arms inwardly toward each other and in turn pinch the sheet material S between the pairs of nip rolls 118. A pair of support bars 130 are each mounted between the roller platen 36 and a respective inner nip roll 118, and each extends in the axial direction of the roller platen to support the sheet material S between the roller platen and respective nip roll.

Accordingly, the sheet material S and ink web W are pressed against the roller platen 36 by the print head 34 along substantially the entire length of the print head, and the sheet material is further maintained in conforming engagement with the roller platen and support bars by the nip rolls 118 and bail assemblies 124 to directly drive the sheet and ink web with the platen drive motor and roller platen. The registration sprockets 106, on the other hand, engage the feed holes H to guide and steer the sheet material, and in turn prevent skewing of the sheet material under the driving force of the platen, and maintain precise registration of the sheet with the print head.

As also described in the above-mentioned co-pending patent application and shown in FIG. 9, a positional sensor 132 is preferably mounted adjacent to the sprocket shaft 110 to track the rotational position of the registration sprockets 106 and thus the position of the sheet material S engaged by the sprockets. The positional sensor 132 is also coupled to the controller 20 and transmits signals to a register in the controller indicative of the rotational direction and position of the sprocket shaft 110, and thus of the rotational direction and position of the registration sprockets 106 mounted to the shaft. As will be recognized by those skilled in the pertinent art, any of numerous known types of sensors may be employed, including, for example, a suitable resolver or encoder, such as an optical encoder, for encoding the registration sprockets or sprocket shaft and generating signals indicative of their rotational direction and position.

Accordingly, the controller 20 selectively energizes the heating elements of the print head in accordance with the printing program in response to the positional signals transmitted by the sensor 132 coupled with the image data. Because the feed holes H maintain precise registration of the sheet material with the print head, and the positional signals transmitted by the sensor 132 are based on the position of the sprockets 106 engaging the feed holes H, the graphic images are accurately printed on the sheet material in accordance with the printing program.

As will be recognized by those skilled in the pertinent art, other drive systems may be employed to drive the sheet material S in an apparatus embodying the present invention. For example, it may be desirable to rotatably drive both inner pinch rolls 118 in addition to the roller platen 36. In this instance, all three rollers may be driven together by a common drive belt or other suitable drive train, such as a gear assembly. In addition, it may likewise be desirable to drive the nip rolls on the outlet side of the roller platen at a faster surface (i.e., tangential) speed than the roller platen, which may in turn be driven at a faster surface speed than the nip rolls on the inlet side of the roller platen, in order to ensure that the sheet material remains taut and does not buckle or otherwise become distorted upon passage between the roller platen and print head.

Alternatively, the sheet material S may be driven by the sprockets 106, which may in turn be assisted by the roller platen 36, as disclosed and claimed for example, in U.S. Pat. No. 5,551,786, dated Sep. 3, 1996, entitled "Method and Apparatus for Making a Graphic Product", which is also hereby expressly incorporated by reference as part of the present disclosure. In this case, the sprocket shaft 110 of FIG. 3 may be directly driven by the motor 117, and the roller platen 36 and inner nip rolls 118 may be driven by common drive belts (not shown) coupled through pulleys to the roller platen, inner nip rolls, and sprocket shaft at each end of the platen. The sprockets 106 would therefore positively engage the feed holes H of the sheet material and thereby control the speed of the sheet, whereas the roller platen and nip rolls would be tangentially driven off the sprocket shaft to assist in driving the sheet. The pulleys engaging the drive belts may be selected to establish a peripheral speed of the roller platen and/or of one of the inner nip rolls which is slightly higher than that of the sprockets to augment feeding of the sheet material; and the common drive belts may be, for example, o-rings or v-belts designed to allow limited slip.

Accordingly, as will be recognized by those skilled in the pertinent art, numerous changes and modifications may be made to these and other embodiments of the present invention without departing from its scope as defined in the appended claims.

What is claimed is:

1. An apparatus for printing graphic products on sheet material having calibrated print-head movement in a lateral direction of the sheet, comprising:

a print head including a substantially linear array of heating elements extending in a lateral direction of the sheet material, the print head being movable between first and second positions in the lateral direction of the sheet for printing graphic images on the sheet wider than the length of the linear array;

means for controlling a first group of heating elements located at approximately a first end of the linear array to print a plurality of first indicia spaced relative to each other on the sheet material;

means for moving the print head in the lateral direction of the sheet material and positioning a second group of heating elements located at approximately a second end of the linear array to overlap the first indicia;

means for controlling the second group of heating elements to sequentially print a plurality of second indicia in spaces defined between adjacent first indicia, and for incrementally moving the print head in the lateral direction of the sheet material between printing sequential second indicia; and means for adjusting the distance between the first and second positions of the print head based on the incremental movement of the print head corresponding to a selected one of the second indicia.

2. An apparatus as defined in claim 1, wherein the selected one of the second indicia is approximately equally spaced between adjacent first indicia.

3. An apparatus as defined 1, wherein the plurality of first indicia are equally spaced relative to each other on the sheet material.

4. An apparatus as defined in claim 3, wherein each second indicia is equal in width to the space defined between adjacent first indicia.

5. An apparatus as defined in claim 1, wherein the means for controlling a first group of heating elements prints a plurality of pairs of spaced first indicia.

6. An apparatus as defined in claim 5, wherein the plurality of pairs of first indicia define an approximately equal space between the two indicia of each pair.

7. An apparatus as defined in claim 1, further comprising means for printing a plurality of characters adjacent to the second indicia, each character identifying a respective second indicia.

8. An apparatus as defined in claim 7, wherein the means for adjusting the distance between the first and second positions of the print head is embodied in an electronic computer and is responsive to an electronic input identifying a respective character to adjust the distance between the first and second positions.

9. An apparatus as defined in claim 1, wherein the lateral direction of the sheet material is the y-coordinate direction, the first end of the linear array is the lower end in the y-coordinate direction, and the second end of the linear array is the upper end in the y-coordinate direction.

10. An apparatus as defined in claim 9, wherein the print head is incrementally moved upwardly in the y-coordinate direction between printing sequential second indicia.

11. An apparatus as defined in claim 1, wherein the means for adjusting the distance between the first and second positions creates a new second position based on the sum of an old second position and the total incremental movement of the print head corresponding to the selected second indicia.

12. An apparatus as defined in claim 1, wherein the means for moving the print head includes a step motor drivingly connected to the print head for movement between the first and second positions, and the incremental movement of the print head between printing sequential second indicia corresponds to a predetermined number of steps of the motor.

13. An apparatus as defined in claim 12, wherein the means for moving the print head further includes a lead screw coupled between the print head and the step motor for laterally moving the print head in response to rotation of the motor.

14. An apparatus as defined in claim 2, further comprising means for sensing the second indicia equally spaced between adjacent first indicia and transmitting signals to the means for adjusting the distance between the first and second positions indicative thereof.

15. A method for calibrating print-head movement in an apparatus for printing graphic products on sheet material, wherein a print head has a substantially linear array of heating elements and is movable in a lateral direction of the sheet, comprising the following steps:

controlling a first group of heating elements located at approximately a first end of the linear array to print a plurality of first indicia spaced relative to each other on the sheet material;

moving the print head in a lateral direction of the sheet material and positioning a second group of heating elements located at approximately a second end of the linear array to overlap the first indicia;

controlling the second group of heating elements to sequentially print a plurality of second indicia in spaces defined between adjacent first indicia, and incrementally moving the print head in the lateral direction of the sheet material between printing sequential second indicia; and adjusting the distance between the first and second positions of the print head based on the incremental movement of the print head corresponding to a selected one of the second indicia.

16. A method as defined in claim 15, wherein the selected second indicia is approximately equally spaced between adjacent first indicia.

17. A method as defined in claim 15, comprising the step of printing a plurality of first indicia equally spaced relative to each other on the sheet material.

18. A method as defined in claim 15, wherein each second indicia is approximately equal in width to the space defined between adjacent first indicia.

19. A method as defined in claim 15, comprising the step of printing a plurality of pairs of spaced first indicia.

20. A method as defined in claim 15, comprising the step of printing a plurality of characters adjacent to the second indicia, each character identifying a respective second indicia.

21. A method as defined in claim 15, comprising the step of adjusting the distance between the first and second positions by generating a new second position based on the sum of an old second position and the total incremental movement of the print head corresponding to the selected second indicia.

22. A method as defined in claim 15, wherein the print head is moved in the y-coordinate direction between printing sequential second indicia.

* * * * *